United States Patent [19]

Gross et al.

[11] Patent Number: 4,891,680

[45] Date of Patent: Jan. 2, 1990

[54] TRANSFER APPARATUS

[75] Inventors: Robert A. Gross, Penfield; James E. Hogle, Williamson, both of N.Y.

[73] Assignee: Xerox Corporation, Stamford, Conn.

[21] Appl. No.: 185,727

[22] Filed: Apr. 25, 1988

[51] Int. Cl.[4] ..... G03G 15/00

[52] U.S. Cl. ..... 355/309; 355/271; 355/274

[58] Field of Search ..... 355/3 TR, 14 TR, 3 R, 355/309, 271, 274

[56] References Cited

U.S. PATENT DOCUMENTS

| | | | |
|---|---|---|---|
| 3,620,617 | 11/1971 | Kelly | 355/3 |
| 3,936,174 | 2/1976 | Carpenter | 355/3 R |
| 4,268,157 | 5/1981 | Ebi et al. | 355/3 TR |
| 4,423,951 | 1/1984 | Rightmyre | 355/3 TR |
| 4,801,975 | 1/1989 | Kano et al. | 355/3 TR X |
| 4,806,967 | 2/1989 | Newbury | 355/3 TR X |

*Primary Examiner*—A. C. Prescott

*Attorney, Agent, or Firm*—H. Fleischer; J. E. Beck; R. Zibelli

[57] ABSTRACT

An apparatus which transfers a developed image from a photoconductive surface to a copy sheet. The apparatus includes a corona generating device arranged to charge the copy sheet. This establishes a transfer field that is effective to attract the developed image from the photoconductive surface to the copy sheet. A sheet guide, adapted to have a portion thereof contiguous with the corona generating device, maintains the copy sheet substantially wrinkle free as it is being guided into contact with the photoconductive surface in the transfer field.

3 Claims, 2 Drawing Sheets

TRANSFER APPARATUS

Figure 1:
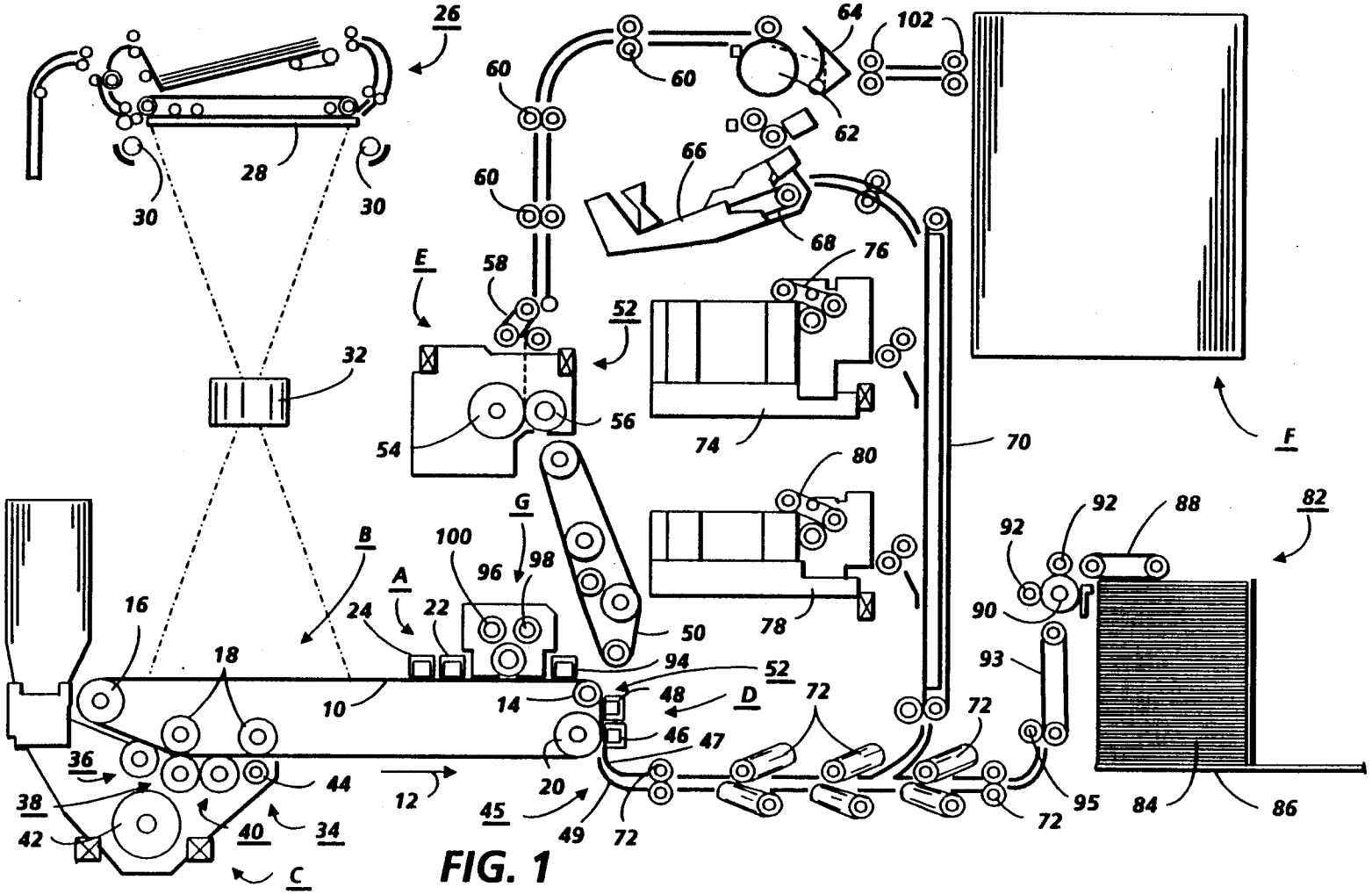

This invention relates generally to an electrophotographic printing machine, and more specifically concerns an apparatus for transferring a developed image from a photoconductive surface to a copy sheet.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner powder image is then transferred from the photoconductive member to a copy sheet. Heat is applied to the toner particles to permanently affix the powder image to the copy sheet.

High speed commercial printing machines of the foregoing type handle a wide range of differing weight copy sheets. The beam strength of the copy sheet is a function of the weight of the sheet. Heavier weight copy sheets have greater beam strength than lighter weight copy sheets. Inasmuch as the sheet conveying system of the printing machine handles a wide range of differing weight copy sheets, it is not unusual for the copy sheet to be wrinkled before it is transported to the processing station where the developed image is transferred to the copy sheet. The stack of copy sheets placed in the sheet feeder may be initially wrinkled, or the copy sheets may become wrinkled as they fed from the stack of the transfer station. At the transfer station, the copy sheet adheres to the photoconductive member. In the event the copy sheet is wrinkled, it is not held in intimate contact with the photoconductive surface. Image voids will occur when the copy sheet is not held in intimate contact with the photoconductive surface when the toner powder image is being transferred thereto. In the typical electrophotographic printing machine, the copy sheet is held against the photoconductive surface by an electrostatic charge on the photoconductive surface. However, this charge is often insufficient to securely hold the wrinkled part of the copy sheet against the photoconductive surface. Accordingly, when the wrinkled portion of the copy sheet reaches the photoconductive surface, it separates from it causing a void on this part of the copy sheet. Clearly, an image void is very undesirable in that useful information and indicia are not reproduced on the copy sheet. Hereinbefore, mechanical devices, such as rollers, have been used to press the copy sheet against the toner powder image on the photoconductive surface. However, a roller pressing the copy sheet against the toner powder image on the photoconductive surface will frequently smear the toner powder image resulting in a distorted image being transferred to the copy sheet. Furthermore, rollers compact the toner particles making it difficult to transfer the toner powder image from the photoconductive surface to the copy sheet. This results in a loss of transfer efficiency.

Various approaches have been devised for solving this problem. The following disclosures appear to be relevant:

U.S. Pat. No. 3,620,617, Patentee: Kelly, Issued: Nov. 15, 1971.

U.S. Pat. No. 3,936,174, Patentee: Carpenter, Issued: Feb. 3, 1976.

U.S. Pat. No. 4,268,157, Patentee: Ebi et al., Issued: May 19, 1981.

U.S. Pat. No. 4,423,951, Patentee: Rightmyre, Issued: Jan. 3, 1984.

The relevant portions of the foregoing patents may be summarized briefly as follows:

U.S. Pat. No. 3,620,617 discloses a method of transferring a toner image for use in an electrophotographic apparatus. A copy sheet is passed between a photoconductive member and a transfer corona generator. A Mylar flap may partially cover the transfer corona generator, or a Nylon or Dacron mesh may cover the entire transfer station. A high negative charge is built up on the flap or mesh which repels a negative charge on the copy paper. This creates an increased pressure between the paper on the flap or mesh below the paper helps the toner to be attracted from the photoconductive surface of the drum to the paper.

U.S. Pat. No. 3,936,174 describes an image transfer system for use in an electrophotgraphic printing machine. A copy sheet is passed through a transfer nip created by a cylindrical transfer roller and a photoconductive drum. The copy sheet is held against the photoconductive drum. A transfer field is generated by stationary, electrically biased conductive electrodes located within the transfer roller. The transfer field attracts the toner image from the photoconductive drum to the copy sheet.

U.S. Pat. No. 4,268,157 teaches a toner image transfer method using an endless belt as a transfer member. A toner image is formed on a photoconductive drum. A copy sheet is fed through a guide into a nip between the drum and the transfer belt. The copy sheet is then lightly pressed against the drum by the belt and the toner image on the drum is electrostatically attracted to the sheet.

U.S. Pat. No. 4,423,951 discloses a roller transfer corona apparatus employable for eliminating image voids associated with copying onto a folded sheet. A roller member engages the copy sheet and forces the sheet into contact with a photoconductive drum. Substantially simultaneously with the copy sheet being held in contact with the drum, transfer corona wires on either side of the push roller provide a charge to cause the transfer of toner from the photoconductive drum to the copy sheet.

The present invention is also concerned with an electrophotographic printing machine of the type in which a developed image is transferred from a photoconductive surface to a copy sheet at a transfer station. The improvement includes means for advancing the copy sheet to the transfer station. A corona generating device, positioned at the transfer station, charges the copy sheet. This establishes a transfer field that is effective to attract the developed image from the photoconductive surface to the copy sheet. A sheet guide, positioned between the advancing means and corona generating device, is adapted to have a portion thereof contiguous with the corona generating device to maintain the copy sheet substantially wrinkle free as it is being guided into contact with the photoconductive surface at the transfer station.

Figure 2:
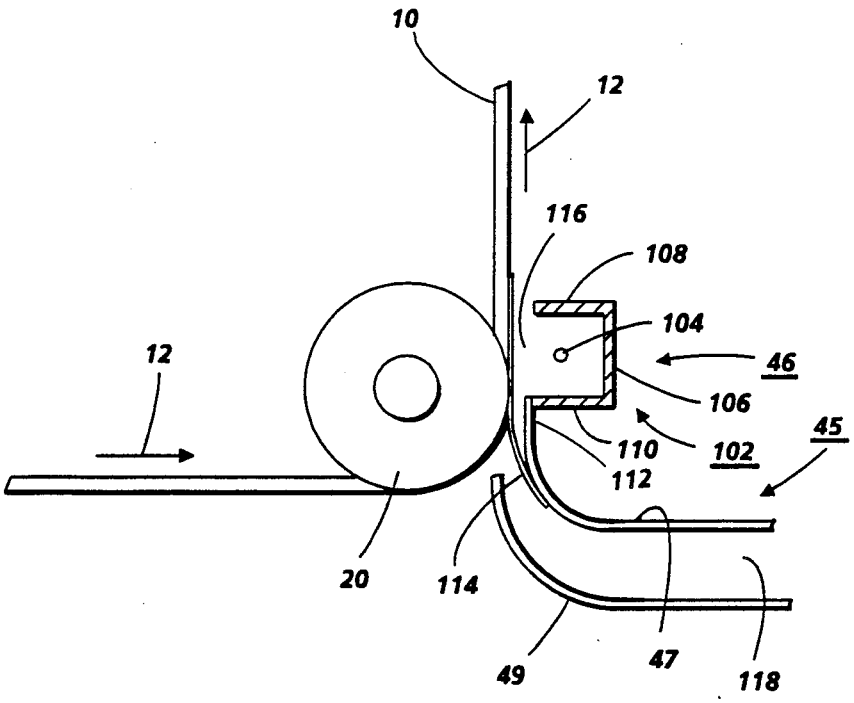

Other aspects of the present invention will become apparent as the following description proceeds and upon reference to the drawings, in which:

FIG. 1 is a schematic elevational view depicting an illustrative electrophotographic printing machine incorporating the apparatus of the present invention therein; and FIG. 2 is an elevational view showing the sheet guide and transfer apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

For a general understanding of the features of the present invention, reference is made to the drawings. In the drawings, like reference numerals have been used throughout to identify identical elements. FIG. 1 schematically depicts an electrophotograhic printing machine incorporating the features of the present invention therein. It will become evident from the following discussion that the apparatus of the present invention may be employed in a wide variety of electrostatographic printing machines and is not specifically limited in its application to the particular embodiment depicted herein.

Referring now to FIG. 1 of the drawings, the electrophotograhic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of photoconductive belt 10 passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder, located below the tray, feeds the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses the light image of the original document onto the charged portion of the photoconductive surface of belt 10 to selectively dissipate the charge thereon. This records an electrostatic latent image on photoconductive belt 10 which corresponds to the information areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. The copy sheet is frequently wrinkled. First, photoconductive belt 10 is exposed to a pre-transfer light from a lamp (not shown) to reduce the attraction between photoconductive belt 10 and the toner powder image. The copy sheet is advanced along the sheet path and guided into contact with the toner powder image on photoconductive surface 12 by a sheet guide, indicated generally by the reference numral 45. Sheet guide 45 has an upper, generally planar guide 47 and a lower, generally planar guide 49. Upper guide 47 is contiguous with a corona generating device, indicated generally by the reference numeral 46. The copy sheet is frequently wrinkled when placed in the copy printing machine, or becomes wrinkled when it is moving freely, i.e. unguided, from the sheet stack to the transfer station. The continuous guiding of the sheet into contact with the toner powder image at the transfer station. The planar surface of upper guide 47 flattens the copy during contact with the photoconductive surface of belt 10. In this way, the copy sheet is placed in intimate contact with the toner powder image on the photoconductive surface. Corona generating devices 46 charges the copy sheet to the proper magnitude and polarity so that the copy sheet is tacked to photoconductive belt 10 and the toner powder image attracted from the photoconductive belt to the copy sheet. Further details of the apparatus for insuring that the copy sheet is in intimate contact with the photoconductive surface at the transfer station will be described hereinafter with reference to FIG. 2.

After transfer, corona generator 48 charges the copy sheet to the opposite polarity to detack the copy sheet from belt 10. As belt 10 continues to move in the direction of arrow 12, the beam strength of the copy sheet causes he copy sheet to separate from belt 10. Conveyor 50, positioned to receive the copy sheet, advances it to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent is transferred to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding roller pairs 60 then advance the sheet to duplex turn roll 62. Duplex solenoid gate 64 guides the sheet to the finishing station F or to duplex tray 66. In the finishing station, the copy sheets are collected in sets with the copy sheets of each set being stapled or glued together. Alternatively, duplex solenoid gate 62 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70, rollers 72, and sheet guide 45 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. Secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and sheet guide 45, and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and sheet guide 45, and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet to sheet guide 45 which guides the sheet into the transfere zone at transfer station D.

Invariably, after the copy sheet is separated from photoconductive belt 10, some residual particles remain adhering thereto. After transfer, photoconductive belt 10 passes beneath corona generating device 94 which charges the residual toner particles to the proper polarity. Thereafter, the precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Referring now to FIG. 2, there is shown a fragmentary, elevational view further illustrating the features of the present invention. As shown thereat, corona generating device 46 includes a generally U-shaped shield, indicated generally by the reference numeral 102, and an elongated electrode wire 104. Shield 102 has a back wall 106 and opposed, spaced side walls 108 and 110 secured thereto. Side wall 110 is foreshortened permitting end 112 of upper guide 47 to be contiguous therewith. One skilled in the art will appreciate that any suitable corona generating device may be employed. For example, the electrode of the corona generator may be spaced pins, or the shield may only have side walls and no back wall. Corona generating device 46 is energized to charge copy sheet 114 causing it to adhere to belt 10. The charged copy 114 sheet attracts the toner powder image from photoconductive belt 10. End 112 of upper guide 47 of corona is contiguous with side wall 110 generating device 46. As shown, corona generating device 46 is positioned at transfer station D. The corona generating device is spaced from photoconductive belt 10 to define a gap 116 through which copy sheet 114 passes. Inasmuch as upper guide 47 is contiguous with corona generating device 46 and positively guides sheet 114, it flattens the wrinkles in sheet 114 as it contacts the toner powder image. Thus, a substantially wrinkle free copy sheet is placed in contact with the toner powder image at the transfer station. This insures that copy sheet 114 is in intimate contact with the toner powder image preventing the formation of voids in the transferred tonwer powder image. Preferably, sheet guide 45 is made from sheet metal. Thus, upper guide 47 is preferably a generally planar sheet metal guide having one end thereof contiguous with side wall 110 of shield 102 of corona generating device 46. Lower guide 49 is a generally planar sheet metal guide spaced from upper guide 47 defining a space 118 therebetween through which copy sheet 114 passes. As copy sheet 114 passes through space 118, the sheet is flattened and the wrinkles therein removed. The sheet is guided into intimate contact with the toner powder image on photoconductive belt 10.

In recapitulation, the transfer apparatus of the present invention includes a generally planar sheet guide having one end thereof contiguous with a corona generating device. The corona generating device generates a transfer field and one end of the sheet guide is contiguous therewith. This insures that a substantially wrinkle free copy sheet is placed in intimate contact with the toner powder image on the photoconductive surface. In this way, the toner powder image is transferred to the copy sheet without any voids.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An electrophotographic printing machine of the type in which a developed image is transferred from a photoconductive surface to a copy sheet at a transfer station, wherein the improvement includes:

means for advancing a copy sheet to the transfer station;

a corona generating device, positioned at the transfer station, for charging the copy sheet to establish a transfer field that is effective to attract the developed image from the photoconductive surface to the copy sheet; and a sheet guide, positioned between said advancing means and said corona generating device, having a generally planar region with one end thereof contiguous with said corona generating device to flatten the copy sheet as the copy sheet contacts the developed image on the photoconductive surface so that a substantially wrinkle free copy sheet contacts the developed image during transfer of the developed image from the photoconductive surface thereto to prevent the formation of voids in the transferred developed image.

2. A printing machine according to claim 1, wherein said corona generating device includes a shield comprising at least opposed, spaced side walls with one of the side walls of said shield being foreshortened to enable said one end of said sheet guide to extend at least partially, therebeneath.

3. A printing machine according to claim 2, wherein said planar region is positioned so that the other end thereof receives the copy sheet from said advancing means.

* * * * *